US011104483B2

(12) United States Patent
Mardukhayev et al.

(10) Patent No.: US 11,104,483 B2
(45) Date of Patent: Aug. 31, 2021

(54) BOTTLE OUTER COVER/LINER FOR SEPARATING CLEAN WATER/LIQUID AND BLOCKING OFF CONTAMINANTS ON OUTSIDE SURFACES WHILE TRANSFERRING THE CLEAN WATER/LIQUID FROM WITHIN THE BOTTLE INTO A RESERVOIR OR DISPENSER AND KEEPING THE CONTAMINATES AWAY FROM THE AMBIENT ENVIRONMENT DURING STORAGE OF USE

(71) Applicants: Jane Mardukhayev, Brooklyn, NY (US); Jack Kadymir, Brooklyn, NY (US)

(72) Inventors: Jane Mardukhayev, Brooklyn, NY (US); Jack Kadymir, Brooklyn, NY (US)

( * ) Notice: Subject to any disclaimer, the term of this patent is extended or adjusted under 35 U.S.C. 154(b) by 441 days.

(21) Appl. No.: 15/854,068

(22) Filed: Dec. 26, 2017

(65) Prior Publication Data

US 2018/0282022 A1 Oct. 4, 2018

Related U.S. Application Data

(60) Provisional application No. 62/588,355, filed on Nov. 19, 2017, provisional application No. 62/480,562, filed on Apr. 3, 2017.

(51) Int. Cl.
*B65D 23/08* (2006.01)
*B65D 23/10* (2006.01)

(52) U.S. Cl.
CPC ..... *B65D 23/0842* (2013.01); *B65D 23/0871* (2013.01); *B65D 23/106* (2013.01)

(58) Field of Classification Search
CPC ..... B65D 23/08; B65D 23/10; B65D 23/102; B65D 23/106; B65D 23/0842; B65D 23/0871; B65D 25/34; B65D 25/2805; B65D 25/2814; B65D 25/2885; B65D 25/2897; B65D 59/04; B65D 65/02; B65D 65/04; B65D 65/08; B65D 65/12; B65D 65/44; B65D 71/14; B65D 71/38; B65D 71/30; B65D 81/02; B65D 81/025; B65D 81/38; B65D 81/3837; B65D 81/3876
USPC ..... 215/296; 229/89–91; 222/185.1
See application file for complete search history.

(56) References Cited

U.S. PATENT DOCUMENTS 622,715 A * 4/1899 Scheufler ..... B65D 23/0842 229/89
10,377,559 B1 * 8/2019 Boomsma ..... A47G 23/0258

FOREIGN PATENT DOCUMENTS

FR 2998878 A1 * 6/2014 ..... B65D 23/0871

* cited by examiner

*Primary Examiner* — Anthony D Stashick
*Assistant Examiner* — Elisabeth Sullivan
(74) *Attorney, Agent, or Firm* — Lainie E. Farker; Richard M. Blank

(57) ABSTRACT

A Bottle cover/liner for separating clean water or other liquid and blocking it off from the dirt, germs, and bacteria on outside surfaces while the clean water or other liquid is being removed from the bottle into a reservoir or dispenser, as well as, blocking contaminants from air borne movement into the ambient.

15 Claims, 8 Drawing Sheets

Figure 1:
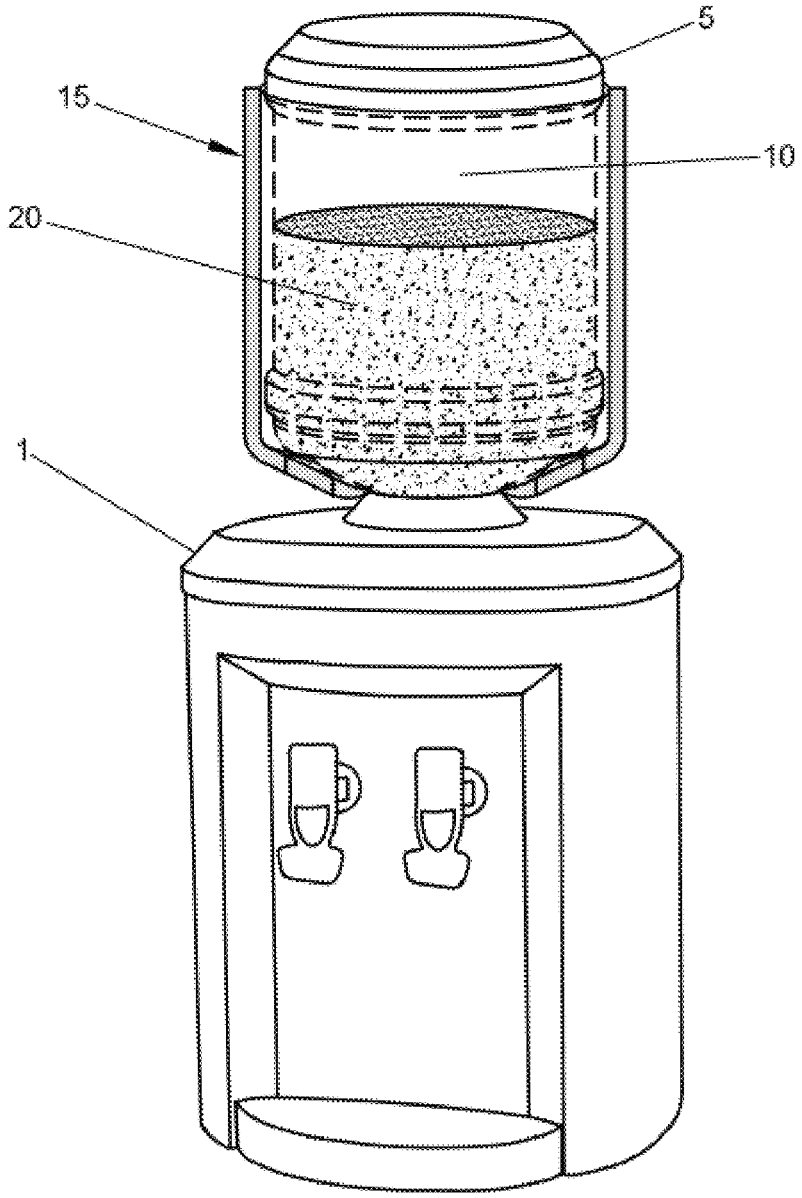

BOTTLE OUTER COVER/LINER FOR SEPARATING CLEAN WATER/LIQUID AND BLOCKING OFF CONTAMINANTS ON OUTSIDE SURFACES WHILE TRANSFERRING THE CLEAN WATER/LIQUID FROM WITHIN THE BOTTLE INTO A RESERVOIR OR DISPENSER AND KEEPING THE CONTAMINATES AWAY FROM THE AMBIENT ENVIRONMENT DURING STORAGE OF USE

PRIORITY

This application takes priority of and benefit of provisional applications No. 62/588,355 filed on Nov. 19, 2017 and No. 62/480,562 filed on Apr. 3, 2017 which are both incorporated in their entirety herein by this reference.

FIELD OF THE INVENTION

This invention relates to a cover/liner for water/liquid bottles, more specifically a cover/liner for water/liquid bottles that are mounted on water dispensers.

BACKGROUND OF THE INVENTION

Drinking water for the home or business in many cases is stored in bottles, and dispensed by removing a cap and seal or a sealable cap thus unsealing a bottle and turning it upside down onto a water dispenser. Other dispensers come in various sizes and shapes and some do not require turning upside down. Water dispensers are usually metal, ceramic or plastic devices, depending upon their size; some are free standing, and others are countertop models. Water dispensers generally have an interior storage chamber for the water, an opening usually on top of the dispenser for receiving an inverted water bottle, and means for dispensing the water from the chamber to the user. When a bottle is inverted onto the dispenser, the water flows into the interior storage chamber. Water dispenser bottles have been found to be round or angular in shape, and are usually made of clear or opaque glass or plastic. In transport, warehousing, storage, among other situations along the way the exterior of the bottles pick up and carry germs, bacteria, and dirt. Also, the exposed areas and even unexposed or partially exposed areas of the dispensers also accumulate and/or carry germs, bacteria, and dirt.

The goals of the present invention include covering or lining on the outside of the bottle with a cover/liner that will separate the contaminated and unclean areas from the clean water flowing from bottle to dispenser to protect the clean water from contamination, as well as, blocking contaminants from air born movement into the ambient.

SUMMARY OF INVENTION

A Bottle cover/liner for separating clean water or other liquid and blocking it off from the dirt, germs, and bacteria on outside surfaces while the clean water or other liquid is being removed from the bottle into a reservoir, the cover/liner comprising of the following: bottle cover/liner formed from at least two separate sheets of flexible and/or retractably expandable material permanently bonded together for creating a tight fit to bottle; having a first end and a second end each with an opening to the ambient (holes); having at least two corresponding pleats, each set of corresponding pleats located on opposite sides of each other providing an ergonomic fit between cover/liner and water/liquid bottle; the said bottle cover/liner can be made of at least one of elastic, rubber, or plastic or stretchable and retractable material(s), in part or in whole. The cover/liner can be shaped to fit snugly as a tight fit to the top narrowest portion of the said bottle, the nasal portion, preventing access to the exterior dirt, germs, and bacteria on the surfaces thus prevent the flowing liquid from carrying said contaminants, and closely fits over the entire said bottle including changes in dimensions from top to bottom in depth, diameter, radius, circumference, and/or perimeter of cover/liner to correspond with similar bottle changes in dimensions. The bottle cover/Liner acts as a shield between the drinking water or other liquid that is to be stored in said reservoir portion of a water/liquid dispensing machine and the perimeter of the receiving section of said dispensing machine before/during/after the bottle is positioned or attached on or to the said dispensing machine, and after the sealable cap has been removed from the bottle. The top and other exposed areas of the outside or outer portion of the water/liquid bottle contains areas of dirt, germs, and bacteria, and it is also covered by the cover/liner and by doing so shields the ambient from dirt and bacteria. The predominate larger barrel cover/liner section of said cover/liner usually rests above the dispenser, whereby said cover/liner becomes a shield between the clean air in a room environment and the bottle, thus preventing the potential air born movement of the dust, germs, and bacteria that stems from or comes from or is attached to the exterior of the water/liquid bottle. This is the same water/liquid bottle that for example gets picked up from being transported and handled from a manufacturing facility to a warehouse, or to a truck, or to your home or business and placed inside for storage, said bottle picks up the said dirt and bacteria and then is placed on top of a water dispensing machine where air constantly is circulating. There can be a nozzle section for a tight fit that does not allow water flowing into water dispensing machine from the bottle to be in contact with any outside or other surface on or in the dispensing machine and outside of water bottle that can be contaminated. The pleats can be self-unfolding, expanding in size, and taking a shape adjustably corresponding to the changes in bottle dimensions between nasal/spout and barrel areas of said bottle. The liner additionally may also be comprised of handles to grip hold of which can be simply the sealing sections between the sheets that are permanently attached together to form the cover/liner which have dual purpose; that they run on both sides of liner along the sides of the liner and can be grabbed at any location for end user convenience. The handles are at the bonding place for both sides the material that the plastic liner is made of. A wide bonding area makes a stronger bond/hold. The cover/liner when being pulled downward from on top of said bottle has pleats that expand and open as the cover/liner is pulled downward and no additional user effort is needed to release the pleats.

The combined total size and shape of all said pleats, plus size and slope of shoulder correspond with the circumference of the liner to produce a close fit.

The cover/liner corresponding section to bottle nasal prior to pulling down the cover/liner over said bottle has a circumference smaller than corresponding bottle nasal section. The cover/liner corresponding section to barrel area on bottle prior to pulling down the cover/liner over said bottle has a circumference larger than corresponding bottle barrel section. The invention additionally can have extended material on the opposite and corresponding two sealed ends of the cover/liner is extended material creating a greater and stronger seal forming a rim or edge with radius and diameter which serves a second purpose continuing from top to bottom of cover/liner also used as a handle on both opposite sides.

The invention can have a "funnel" shape tunnel, with a wider opening on one end and narrower opening on the other end thus providing more direct guidance of the bottle nozzle into the area of destination with ease and to avoid mistake for the user's convenience.

The pleats and handles additionally can provide for an ergonomic fit between cover/liner and bottle and the expansion of the pleats provides for a transformation of the cover/liner from being a flat object into 3-dimensional shape object with ease.

The expansion and retraction of the elastic-material if present provides a tight hold on the cover/liner and bottle, that insures that no liquid from outside can penetrate that hold and no liquid will be contaminated with what is on surface of that bottle.

The Cover/liner's handles can be wide and run the length of the cover/liner on both sides from top to bottom, providing an ease of handling the cover during placing it on top of bottle, where user can change position of his/her hands-on top of handles as many time as needed and can grab onto the handles at any location on handles.

The Pleats are assembled and bonded during manufacturing process thus the User has no need to fold, measure or do any assembly prior cover/liner use.

The quantities of pleats and configuration of curves and shapes are subject to changes and adjustments based on individual specifications of given liquid holding devises like bottles, or barrels.

The number of pleats depends on water bottle shape, size and configuration by different makers of such devices.

Although preferred embodiments of the present invention have been described it will be understood by those skilled in the art that the present invention should not be limited to the described preferred embodiments. Rather, various changes and modifications can be made within the spirit and scope of the present invention as part thereof.

DETAILED DESCRIPTION OF DRAWINGS/FIGURES

FIG. 1 depicts a front view of one type of water cooler with a water bottle in place and showing the invention cover/liner in place covering the water bottle. The bottle is number 5, the cover is number 10, the side handles (flops) are number 15, the water is number 20, and the cooler or dispensing machine is number 1.

Figure 2:
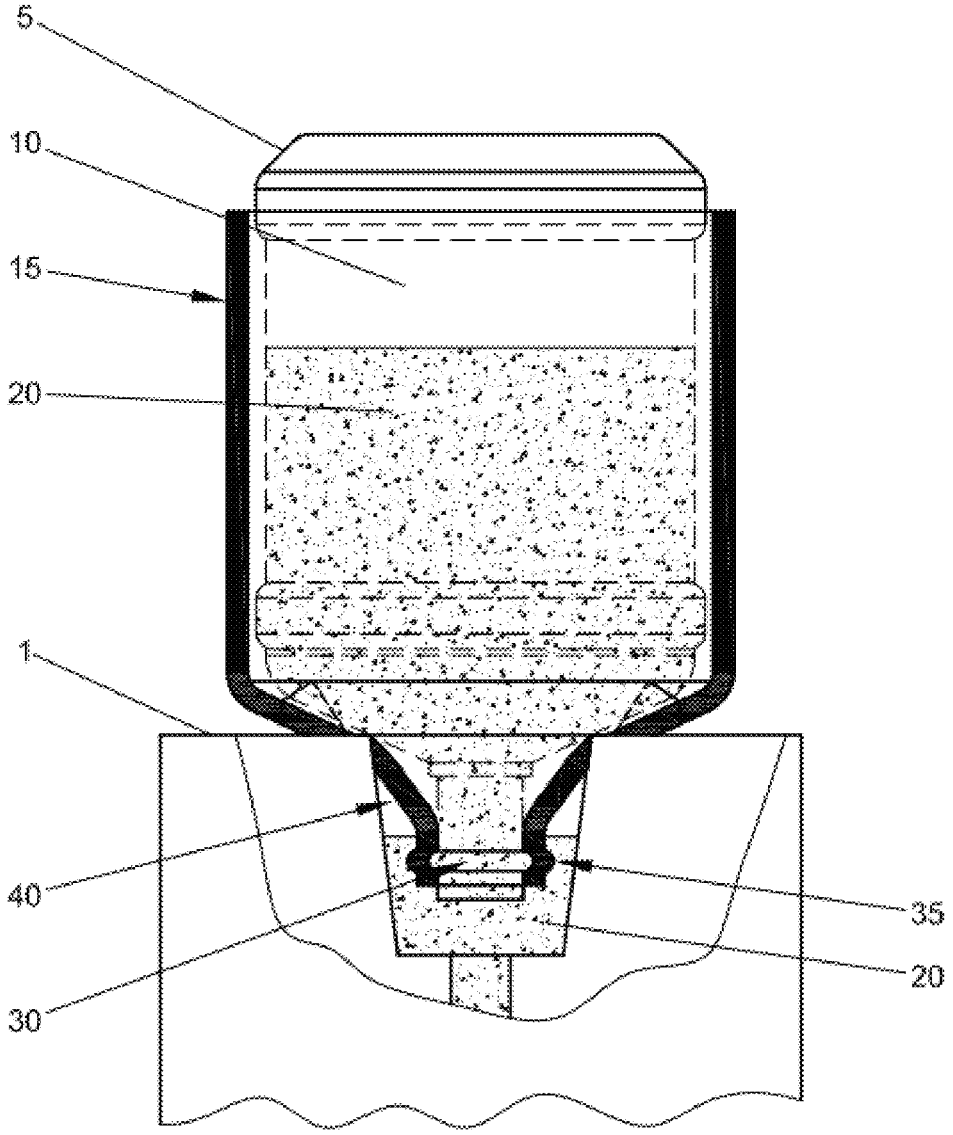

FIG. 2 is a cut-away showing the cover/liner covering a water bottle that is already inserted into the dispenser which depicts a close-up cross section view of a water bottle and cover inserted into a cooler. The bottle is number 5, the cover is number 10, the side handles (flops) are number 15, the water is number 20, and the cooler or dispensing machine is number 1. Both the side bonding strips 15 and the permanent part of liner 10 join both parts of the liner. This makes it easy to grip and pull the liner down/up while applying it on bottle 5. A Funnel shape configuration 40 which is a section or part of the flops 15 that is part of the cover/liner 10 and provides easy and tension free entry for nozzle 30 which is part of bottle 5.

In at least one embodiment the Side Handles number 15 (bonding area) of liner number 10 are made/constructed from 2 plies of stretchable plastic that can be stretched and retracted holding tightly to cover the object it is on.

Nozzle's area 35 of liner 10 has a circumference smaller than nozzle area 30 of bottle 5 prior to use. However, Nozzle's area 35 is made from stretchable and retractable materials. When nozzle area 35 is being pulled down by user force on top of area 30, it deforms or stretches its shape and retracts by taking exact form or shape as it tightens around the bottle, taking shape and size of bottle's area 30 creating a tight grip that does not allow liquids or any foreign materials to get in and/or out of the space between liner and bottle.

Water 20 in reservoir of dispensing machine 1 (FIG. 2) cannot penetrate through liner 10 of area 35.

Dust that sits on top of bottle 5 cannot penetrate through the tight fit between liner's area 35 of liner 10.

Liner 10 locks dust and dirt in barrel area of bottle 5 to prevent it from becoming air born. It protects the room and ambient from outside dirt found on top of the bottle from storage or transportation and contact with unclean objects.

Figure 3:
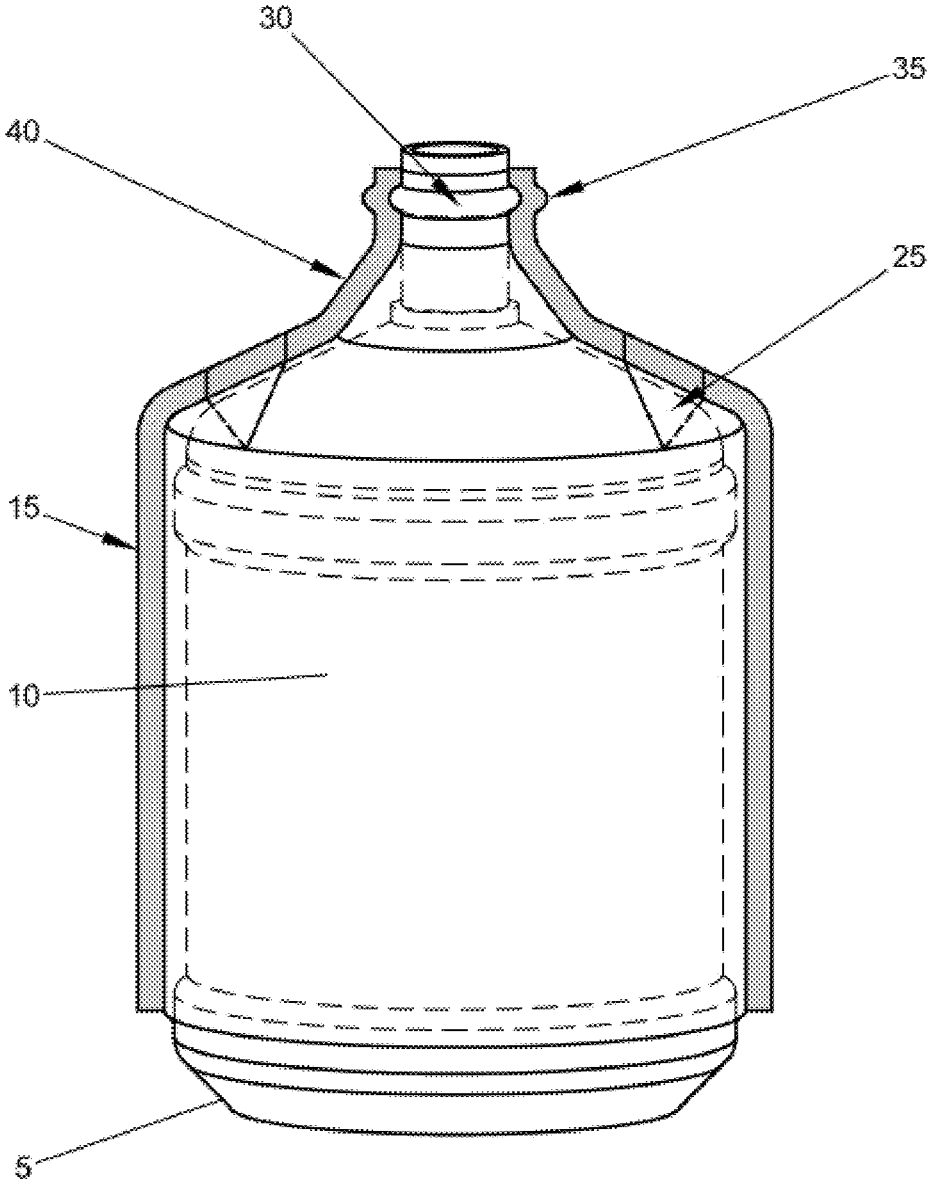

FIG. 3 depicts a front view of a cover/liner on bottle. A funnel shape configuration 40 that is part of 15 that is part of liner 10 provides easy and tension free entry into cover for nozzle 30 which is part of bottle 5.

Figure 4:
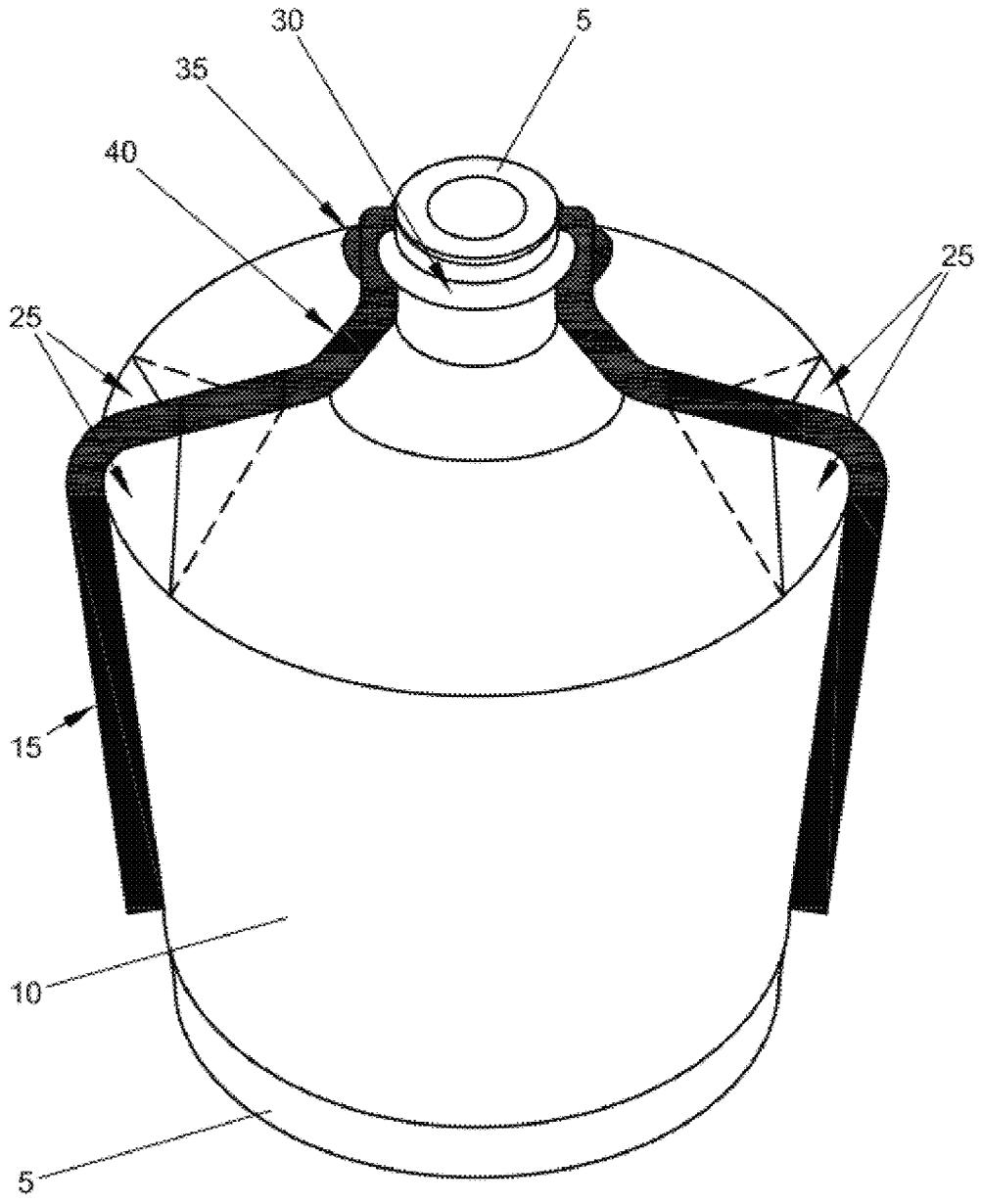

FIG. 4 depicts a front view of a water bottle with a cover and depicts the Pleats in an extended position number 25. The bottle 5 shown on both ends of liner 10.

Pleat number 25 has width that is calculated in a formula which is described below and in the claims. Numbers of pleats depends on water bottle shape, size and configuration and by different makers of such devices. This embodiment shows 4 pleats in total (FIG. 4), 2 pleats on each side.

In other embodiments the number of pleats could be greater number or less. They are used to achieve a tight fit between liner 10 and bottle 5.

FORMULA:

One half the length of the bottle's barrel area circumference less/minus the length of the bottle's barrel area diameter, all divided by the number of pleats on each side of the liner that will be desired or needed, with an equal length/width for each pleat.

$$\frac{\left(\frac{C}{2} - D\right)}{2^*} = W \qquad \text{Formula}$$

C=Circumference of a bottle's barrel area of a water bottle

D=Diameter of a water bottle

W=Width of each pleat (then adjustments can be made based on shoulder slope or bottle design)

2* =number of pleats on each side of liner, which can be 2, as shown, but varies with the water bottle shape, size and configuration, as indicated by the asterisk (*)

Figure 5:
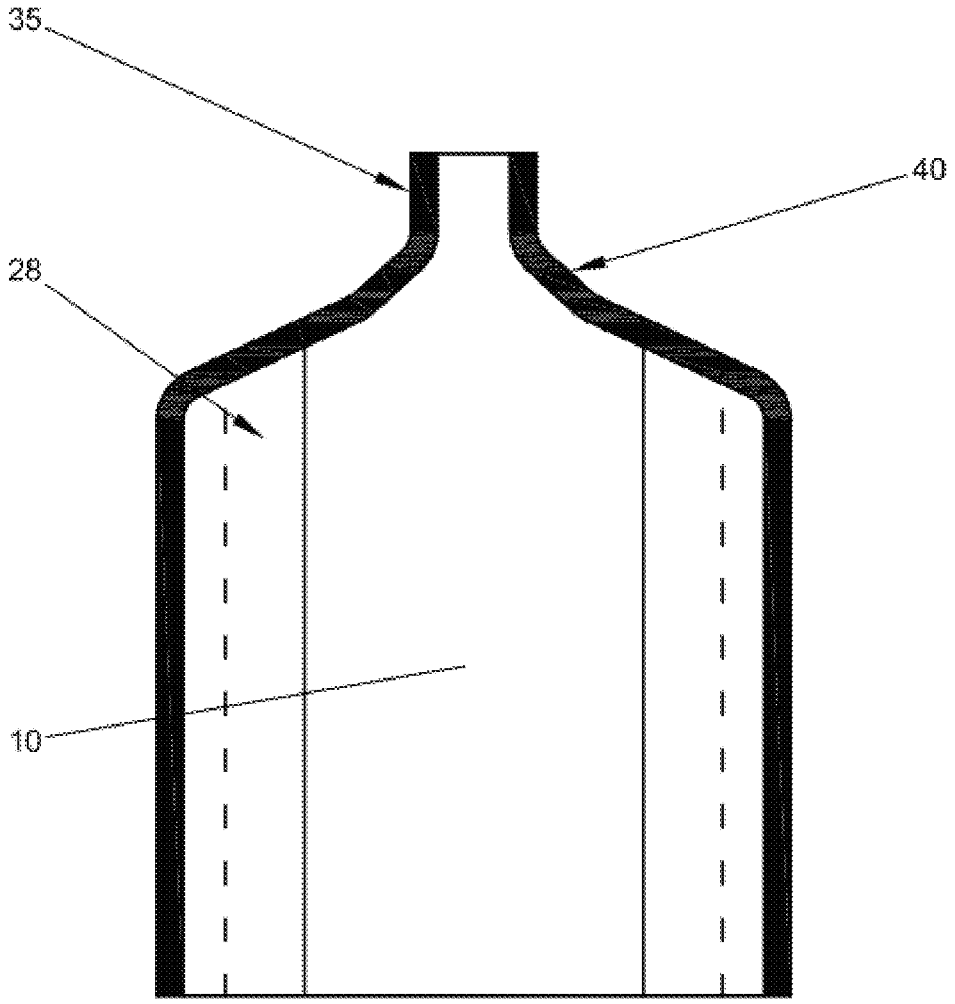

FIG. 5 depicts a frontal view of an assembled liner/cover 10 in after production condition, and before of use, wherein pleats 28 are fully folded and nozzle 35 is in pre-use position. Note: In the figures Pleat 28 is the same Pleat as Pleat 27 but in a different state/format/condition/mode. In other words Pleat 28 is Pleat 27 after it has been folded in manufacturing process. In at least one embodiment The Pleats come fully assembled and no user involvement is needed in the process of extending the pleats. Before use the pleat 28 is folded from one end of liner 10 to another end of liner 10.

Figure 6:
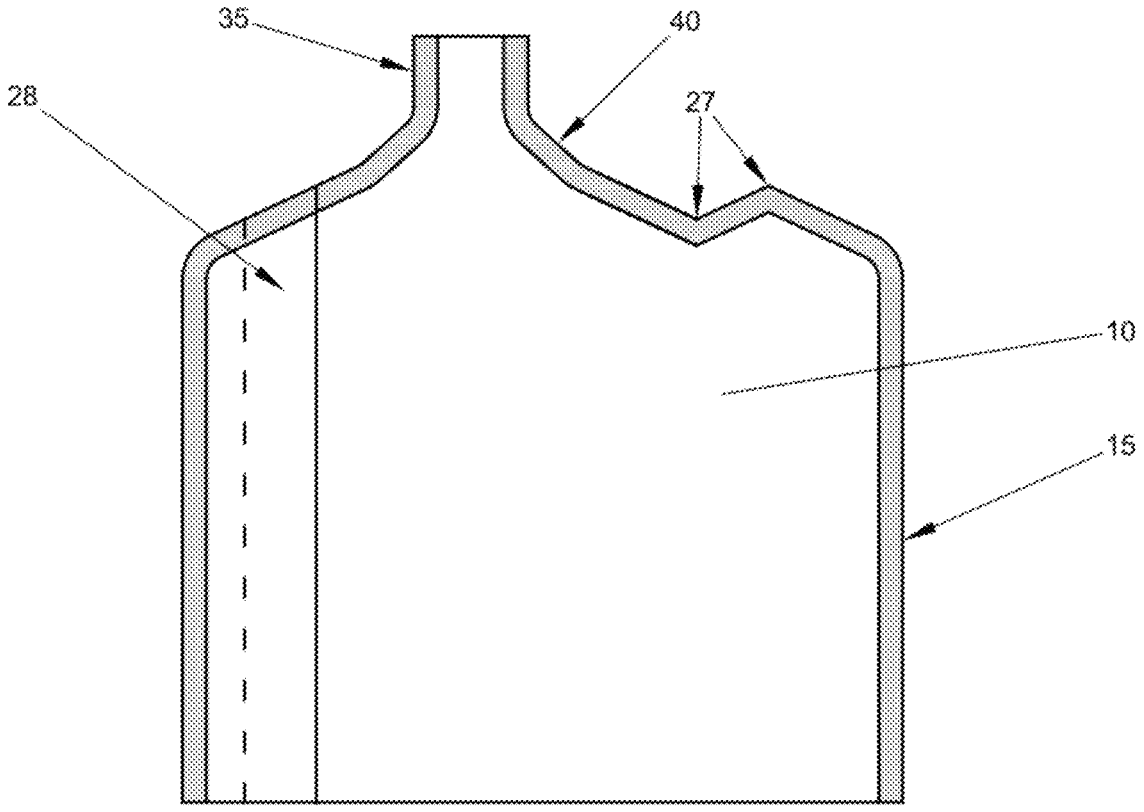

FIG. 6 depicts a front view of the liner 10. One side shows unfolded water liner showing with open pleat 27 in pre-cut extended position. Another side shows transformed folded and bonded in manufacturing process closed pleat 28. This figure shows transformation from open pleat 27 to closed pleat 28.

Figure 7:
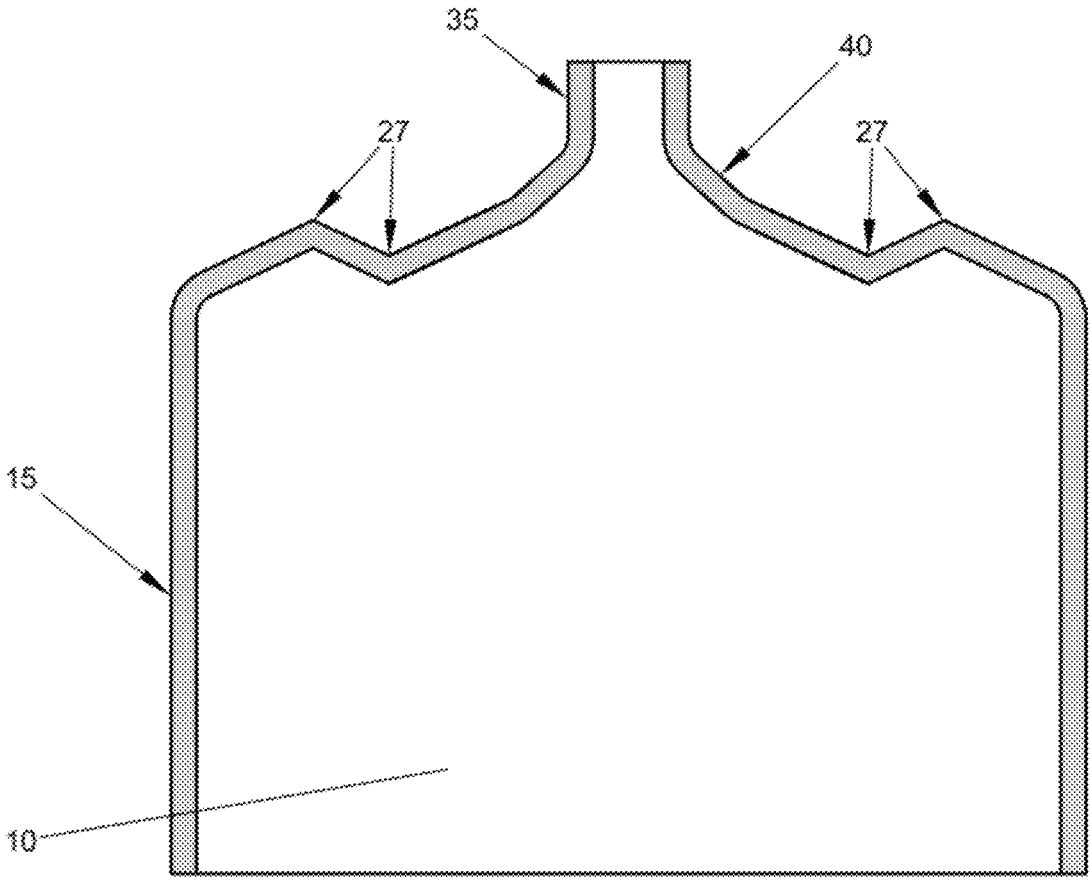

FIG. 7 depicts a front view of water liner 10 fully open in pre-manufacturing condition.

Pleat 25 from FIG. 4 is the same as pleat 28 but in a different condition of being extended after the pleat has been placed on top of bottle 5.

Figure 8:
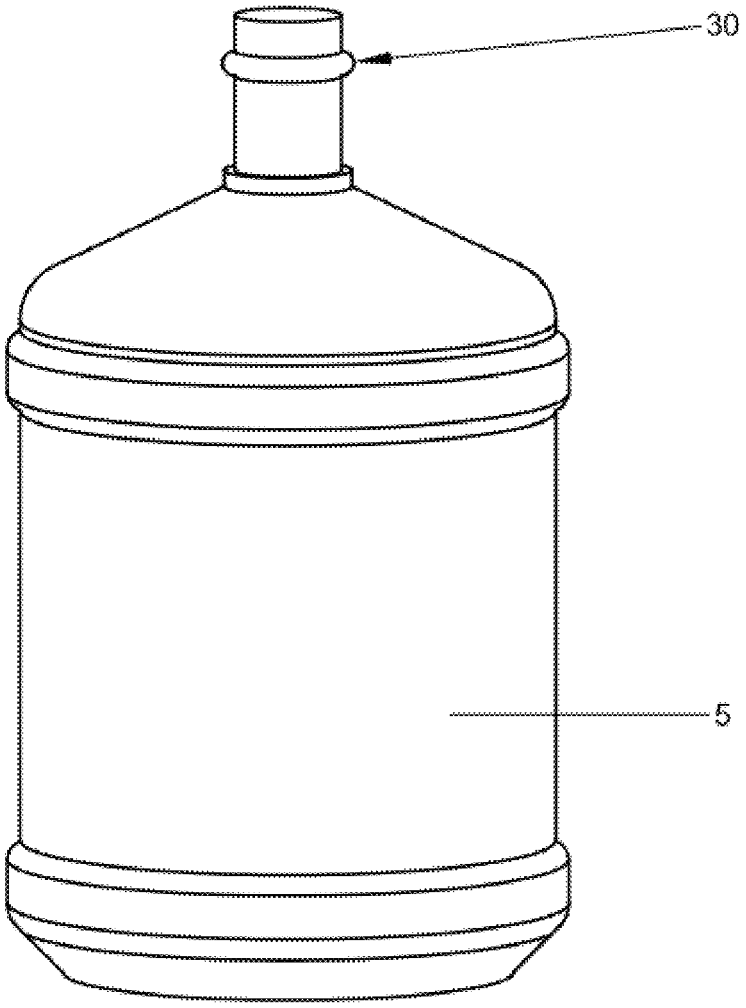

FIG. 8 depicts a water bottle number 5. Also shows bottle nozzle area 30 of bottle 5.

Different manufacturers produce it in different sizes, and shapes.

Pleats:

Pleat 27 shows an open pleat.

Pleat 28 shows a closed pleat, the way the pleat looks during storage of the liner formation.

Pleat 25 shows the pleat in use, when the liner is extended on a bottle.

The formula is used in at least one embodiment to determine the width of the pleats.

In at least one embodiment—Starting from the bottle nozzle area 30 and continuing on the outside of the bottle as the bottle circumference increases in size, the pleat changes into a V-shape as the bottle is being covered by a user. The corner of the V finds its own position on top of the bottle 5. No end-user effort is needed. The end-user only needs to apply liner 10 on top of the bottle 5 by pulling bonded handles section 15 on both sides. No tools or any other devices are needed to apply the liner on top of the bottle. Bonded handles 15 provide convenience in handling liner 10. Cover/liner 10 has nozzle section 35 which changes shape and size when the bottle is being covered.

What is claimed:

1. A bottle cover/liner for separating clean water/liquid and blocking off contaminants on outside surfaces while transferring the clean water/liquid from within a bottle into a reservoir or dispenser and keeping the contaminants away from the ambient environment during storage or use comprising of the following: a bottle cover/liner formed from at least two separate sheets of flexible and/or retractably expandable material permanently bonded together for creating a tight fit to a bottle; having a first end and a second end each with an opening to the ambient; having at least two corresponding pleats, each of the at least two corresponding pleats being located on opposite sides of the bottle cover/liner providing an ergonomic fit between cover/liner and water/liquid bottle, whereby the at least two corresponding pleats of the bottle cover/liner expand and open when the bottle cover/liner is being pulled downward from on top of the bottle and no additional effort is needed to release the at least two corresponding pleats.

2. The invention of claim 1 whereby the said bottle cover/liner is made of at least one of elastic, rubber, or plastic or stretchable and retractable material(s), in part or in whole; and wherein the number of pleats depends on water bottle shape, size and configuration by different makers of such devices.

3. The invention of claim 1, wherein said bottle cover/liner is shaped to fit to a bottle having a top narrowest portion and it is shaped to fit snugly as a tight fit to the top narrowest portion of the bottle, preventing access to contaminants on the surfaces, thus preventing the flowing liquid from carrying said contaminants, and said bottle cover/liner closely fits over the bottle including changes in dimensions from top to bottom in depth, diameter, radius, circumference, and/or perimeter of cover/liner to correspond with similar bottle changes in dimensions.

4. The invention of claim 1 whereby said bottle cover/liner is shaped to cover a dispensing bottle for a water/liquid dispensing machine having a receiving section to receive the dispensing bottle, the bottle cover/liner acts as a shield between the drinking water or other liquid that is to be stored in the water/liquid dispensing machine and a perimeter of the receiving section of the water/liquid dispensing machine before/during/after the dispensing bottle is positioned or attached on or to the water/liquid dispensing machine; and the dispensing bottle having a top narrowest portion and a barrel area, additionally comprising that said pleats have measurements that is calculated in a formula as follows: FORMULA: One half the length of a circumference of the bottle's barrel area less/minus a length of the bottle's barrel area diameter, all divided by the number of the at least two corresponding pleats equals the width for each pleat.

5. The invention of claim 4, wherein the bottle cover/liner further comprises a nozzle section for a tight fit that does not allow water flowing into the water/liquid dispensing machine from the dispensing bottle to be in contact with any outside or other surface on or in the dispensing machine and or on an outside of the dispensing bottle that can be contaminated.

6. The invention of claim 1, wherein said bottle cover/liner is shaped to fit to a bottle having a top narrowest portion and a barrel area, and each of the at least two corresponding pleats are self-unfolding, expanding in size, and taking a shape adjustably corresponding to the changes in bottle dimensions between the top narrowest portion and barrel area of said bottle.

7. The invention of claim 6, wherein the bottle cover/liner has a shoulder section between the top narrowest portion and the barrel area, and the bottle cover/liner has a circumference, whereby the combined total size and shape of each of the at least two corresponding pleats, plus size and slope of the shoulder section correspond with the circumference of the bottle cover/liner to produce a close fit.

8. The invention of claim 7 whereby the number of the at least two corresponding pleats is dependent on the bottle shape and size.

9. The invention of claim 1 whereby the bottle cover/liner has a bottle nasal section and the bottle has a nasal section, and the bottle cover/liner nasal section, prior to pulling down the bottle cover/liner over said bottle, has a circumference smaller than the nasal section of the bottle.

10. The invention of claim 9 whereby when the bottle cover/liner is pulled down onto the nasal section of the bottle, area of the cover/liner expands and retracts so it holds the nasal section of the bottle tight and secure.

11. The invention of claim 1 whereby the bottle cover/liner has a barrel section and the bottle has a barrel section and the barrel section of the bottle cover/liner prior to pulling down the bottle cover/liner over said bottle has a circumference larger than a circumference of the barrel section of the bottle.

12. The invention of claim 1, wherein the bottle cover/liner has a funnel-shaped section between the first end and the second end, the funnel-shaped section having a wider opening on one end and a narrower opening on the other end, thus providing easier placement of the bottle cover/liner on the bottle.

13. The invention of claim 2, wherein expansion and retraction of the elastic-material if present provides a tight hold on the cover/liner and bottle, that insures that no liquid from outside can penetrate that hold and no liquid will be contaminated with what is on the surface of the bottle.

14. A bottle cover/liner for separating clean water/liquid and blocking off contaminants on outside surfaces while transferring the clean water/liquid from within a bottle into a reservoir or dispenser and keeping the contaminants away from the ambient environment during storage or use comprising of the following: a bottle cover/liner formed from at least two separate sheets of flexible and/or retractably expandable material permanently bonded together to form sealed sides for creating a tight fit to a bottle: having a first end and a second end each with an opening to the ambient; having at least two corresponding pleats, each set of the at least two corresponding pleats being located on opposite sides of the bottle cover/liner providing an ergonomic fit between cover/liner and water/liquid bottle; and a handle on each side of the bottle cover/liner which extends from top to bottom of the bottle cover/liner, the handle on each side of the bottle cover/liner being made of extended material on each of the sealed sides of the bottle cover/liner, the extended material creating a greater and stronger bond on the sealed sides on the bottle cover/liner, and the extended material forming a rim or edge with a radius and diameter to form the handle.

15. The invention of claim 14, wherein the handle on each side of the bottle cover/liner is wide, providing an ease of handling the bottle cover/liner during placing it on top of the bottle, whereby a user can change position of his/her hands-on top of handles as many time as needed and can grab onto the handles at any location on handles; and the number of the at least two pleats and configuration of the bottle cover/liner shapes are subject to changes and adjustments base on individual specifications of the bottle.

* * * * *